US011550243B2

(12) United States Patent
Numata et al.

(10) Patent No.: US 11,550,243 B2
(45) Date of Patent: Jan. 10, 2023

(54) IMAGE FORMING APPARATUS CONTROLLING RECORDING MEDIUM LOOP

(71) Applicant: CANON KABUSHIKI KAISHA, Tokyo (JP)

(72) Inventors: Yoshiya Numata, Ibaraki (JP); Kazuyuki Narita, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/460,502

(22) Filed: Aug. 30, 2021

(65) Prior Publication Data

US 2022/0100127 A1 Mar. 31, 2022

(30) Foreign Application Priority Data

Sep. 28, 2020 (JP) ..... JP2020-162086

(51) Int. Cl.
*G03G 15/20* (2006.01)
*G03G 15/00* (2006.01)

(52) U.S. Cl.
CPC ..... *G03G 15/2028* (2013.01); *G03G 15/2064* (2013.01); *G03G 15/657* (2013.01); *G03G 2215/2045* (2013.01)

(58) Field of Classification Search
CPC ..... G03G 15/2028; G03G 15/2064; G03G 2215/2045
See application file for complete search history.

(56) References Cited

U.S. PATENT DOCUMENTS

| | | | | |
|---|---|---|---|---|
| 5,870,114 | A | 2/1999 | Numata et al. | |
| 6,595,515 | B2 | 7/2003 | Numata et al. | |
| 10,712,692 | B2 * | 7/2020 | Kurata | G03G 15/6576 |
| 2006/0222394 | A1 * | 10/2006 | Koshida | G03G 15/657 399/68 |
| 2017/0227897 | A1 * | 8/2017 | Kaino | G03G 15/2028 |

FOREIGN PATENT DOCUMENTS

| | | | |
|---|---|---|---|
| JP | H10-097154 | A | 4/1998 |
| JP | 2003-241453 | A | 8/2003 |

* cited by examiner

*Primary Examiner* — Arlene Heredia
(74) *Attorney, Agent, or Firm* — Venable LLP

(57) ABSTRACT

An image forming apparatus includes a control unit that controls a conveyance velocity of conveying a recording medium by a fixing unit, to form a loop in the recording medium between a transfer nip portion and a fixing nip portion, in which the control unit controls the conveyance velocity to decrease the loop when a rear end of the recording medium reaches a first position that is apart upstream, in the conveyance direction, from a conveying nip portion of a conveying unit, by a distance that corresponds to a circumference length of a pressure-applying rotating member multiplied by an integer.

6 Claims, 10 Drawing Sheets

IMAGE FORMING APPARATUS CONTROLLING RECORDING MEDIUM LOOP

BACKGROUND OF THE INVENTION

Field of the Invention

The present invention relates to an image forming apparatus that uses an electrophotographic system, such as a copying machine, a printer, or a facsimile.

Description of the Related Art

Conventionally, in an image forming apparatus that uses an electrophotographic system, a sheet is conveyed by a conveying unit, and then toner images formed on image bearing members are transferred to the sheet by a transfer portion. Then, the sheet to which the toner images have been transferred is conveyed to a nip portion of a fixing portion to fix the toner images on the sheet. In such an image forming apparatus, a sheet may be conveyed in a state where the sheet is nipped between a fixing portion, a transfer portion, and a conveying unit.

Japanese Patent Application Laid-Open No. 10-97154 discloses an image forming apparatus that forms flexure called a loop in a sheet between a transfer portion and a fixing nip portion of a fixing apparatus, and performs loop control that senses an amount of the formed loop and maintains the amount of the loop at a predetermined amount.

Further, Japanese Patent Application Laid-Open No. 2003-241453 discloses an image forming apparatus that to prevent an image defect due to a bending reaction force generated in a sheet in which a loop is formed, switches a conveyance velocity of a fixing portion to a velocity that decreases a loop amount of the sheet immediately before a rear end of the sheet passes through a transfer portion. That is to say, the transfer portion and the fixing portion convey a sheet while forming a loop in the sheet. Then, the formed loop is decreased before a rear end of the sheet passes through the transfer portion. Consequently, an image defect in the sheet passing between the transfer portion and the fixing portion is prevented.

However, in recent years, various types of sheets have been needed to be conveyed. To convey a sheet short in a conveyance direction, a distance between a transfer portion and a conveying portion provided upstream from the transfer portion and conveying a sheet has become short. Further, since a sheet having high stiffness is conveyed, a value of a bending reaction force generated in the sheet in which a loop is formed has become large. In this case, when a rear end of the sheet passes through the conveying portion, the sheet receives an effect of a bending reaction force of a loop formed by the transfer portion and a fixing portion. As a result, there is a possibility that a sheet behavior is distorted, and an image defect is generated.

Further, a fixing roller has an outer diameter that varies according to rotational phases, due to a component tolerance, a temperature unevenness, or the like. Therefore, a conveyance velocity of a sheet may vary while the fixing roller rotates one time. That is to say, when a loop amount is decreased, the loop amount of a sheet regularly varies. As a result, a loop amount of a sheet between a fixing nip portion and a transfer portion becomes excessive or insufficient, according to rotational phases of the fixing roller, and there has been a possibility that an image defect is generated.

SUMMARY OF THE INVENTION

It is desirable to provide an image forming apparatus that restricts generation of an image defect even if a diameter of a rotating member of a fixing portion varies according to rotational phases.

An image forming apparatus according to an aspect of the present invention includes: a transfer unit that forms a transfer nip portion, and conveys a recording medium while transferring a toner image formed on an image bearing member; a conveying unit that is provided upstream of the transfer unit in a conveyance direction of the recording medium, forms a conveying nip portion, and conveys the recording medium to the transfer unit; a fixing unit that are included a heating rotating member, and a pressure-applying rotating member that forms a fixing nip portion together with the heating rotating member, and conveys the recording medium while heating the toner image transferred to the recording medium by the transfer unit, at the fixing nip portion, to melt and fix the toner image on the recording medium; and a control unit that controls a conveyance velocity of conveying the recording medium by the fixing unit, to form a loop in the recording medium between the transfer nip portion and the fixing nip portion, in which the control unit controls the conveyance velocity to decrease the loop when a rear end of the recording medium reaches a first position that is apart upstream, in the conveyance direction, from the conveying nip portion of the conveying unit, by a distance that corresponds to a circumference length of the pressure-applying rotating member multiplied by an integer.

Further features of the present invention will become apparent from the following description of exemplary embodiments with reference to the attached drawings.

DESCRIPTION OF THE EMBODIMENTS

Figure 1:
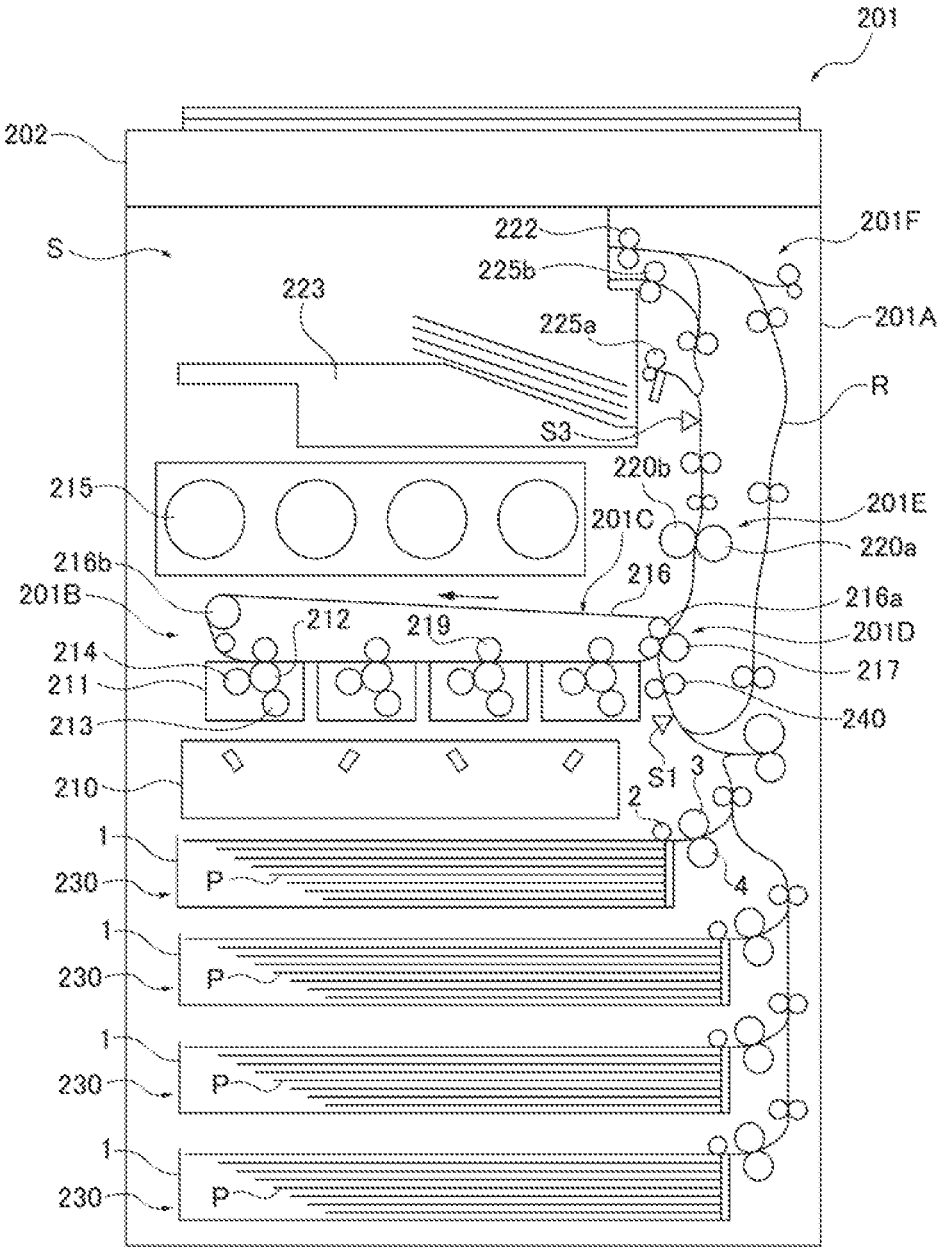
FIG. 1 is a schematic view of an image forming apparatus according to a first embodiment of the present invention.

Hereinafter, embodiments will be described in detail with reference to the drawings.

First Embodiment

Hereinafter, an image forming apparatus according to an embodiment of the present invention will be described in detail, appropriately with reference to the drawings.

<Configuration of Image Forming Apparatus>

A configuration of an image forming apparatus 201 according to a first embodiment of the present invention will be described in detail with reference to FIGS. 1 and 2.

The image forming apparatus 201 forms an image that is full-color or monochrome and corresponds to printing image data output from a host apparatus 501, on a sheet P as a recording medium, and outputs the sheet P on which the image has been formed. Here, a laser beam printer that uses an electrophotographic process and is of a tandem system and an intermediate transfer system is exemplified as the image forming apparatus 201.

More specifically, the image forming apparatus 201 includes an apparatus main body 201A, an image forming portion 201B, a duplex reversing portion 201F, an image reading apparatus 202, and sheet feeding apparatuses 230. The image forming apparatus 201 also includes a controller 400, read-only memory (ROM) 401, random-access memory (RAM) 402, a driver 403, an operation portion 502, an exposure motor M1, a conveying motor M2, an image formation motor M3, a fixing motor M4, and a sheet discharge motor M5. Further, the image forming apparatus 201 includes a registration sensor S1, a loop sensor S2, and a sheet discharge sensor S3. A discharge space S for discharging sheets P is formed between the image reading apparatus 202 and the apparatus main body 201A.

The apparatus main body 201A contains the image forming portion 201B and the like.

The image forming portion 201B forms an image on a sheet P. Here, a four-drum full-color system is exemplified as the image forming portion 201B. Note that details of a configuration of the image forming portion 201B will be described below.

The duplex reversing portion 201F includes a reconveyance passage R that conveys a sheet P on one side of which an image has been formed, to the image forming portion 201B again.

The image reading apparatus 202 is substantially horizontally installed over the apparatus main body 201A.

The sheet feeding apparatuses 230 feed a sheet P to a registration roller 240. The sheet feeding apparatus 230 includes a sheet cassette 1, a pickup roller 2, a feed roller 3, and a retard roller 4.

The sheet cassette 1 contains sheets P.

The pickup roller 2 feeds sheets P contained in the sheet cassette 1, to the feed roller 3 and the retard roller 4.

The feed roller 3 and the retard roller 4 separate and feed sheets P fed from the pickup roller 2, to the registration roller 240.

The controller 400 as a control unit is a central processing unit (CPU) or the like with which the host apparatus 501 is connected. The controller 400 gives and receives information to and from the host apparatus 501 or the operation portion 502. The controller 400 executes programs stored in the ROM 401 to collectively control each operation including an image forming operation of the image forming apparatus 201, perform signal processing, sequence control, and the like to various process equipment, and execute image forming processing described below. Here, the host apparatus 501 is a personal computer, an image scanner, a facsimile, or the like.

The ROM 401 preliminarily stores programs executed by the controller 400. The ROM 401 stores sizes and types of sheets P, image formation color modes, image formation modes of single-sided printing or duplex printing, a control condition table used to selectively guide image formation conditions, and control conditions, such as rotational speeds of each of the motors, that correspond to the image formation modes.

The RAM 402 stores variables of programs executed by the controller 400, variables used for various control, conditions to be changed, among the control conditions stored in the ROM 401, arithmetic values, and set values that can be rewritten according to situations.

Due to control by the controller 400, the driver 403 controls an electric-current value (pulse width modulation (PWM) signal) flowing to the exposure motor M1, the conveying motor M2, the image formation motor M3, the fixing motor M4, or the sheet discharge motor M5 so that the rotational speed becomes a target speed.

The operation portion 502 outputs information input by operation of a user, to the controller 400.

The exposure motor M1 is a motor mainly forming latent images, and performs rotation driving by control by the driver 403.

The conveying motor M2 is a motor mainly performing conveyance of a sheet P, and performs rotation driving by control by the driver 403. The conveying motor M2 uses a gear train, an electromagnetic clutch, and the like of driving transmission that are not illustrated, to rotate each roller for feeding or conveying a sheet P in the image forming portion 201B, at determined timings.

The image formation motor M3 is a motor mainly forming images, and undertaking image formation in the image forming portion 201B. The image formation motor M3 performs rotation driving by control by the driver 403 to form and convey toner images at an extremely accurate constant velocity.

The fixing motor M4 performs rotation driving by control by the driver 403 to mainly make a fixing nip portion of a fixing portion 201E described below convey a sheet P.

The sheet discharge motor M5 performs rotation driving by control by the driver 403 to mainly discharge a sheet P into the discharge space S from the image forming portion 201B, or convey a sheet P to the reconveyance passage R, like a switchback.

The registration sensor S1 as a sensing unit is provided upstream, in a conveyance direction, from the registration roller 240, and detects a front end, in a conveyance direction of a sheet P fed from the sheet feeding apparatus 230 (hereinafter, simply referred to as the "conveyance direction"), of the sheet P, and outputs the detection result to the controller 400.

The loop sensor S2 is a photointerrupter that detects the presence or absence of light interruption according to a loop amount of a sheet P conveyed in the image forming portion 201B, and outputs a signal corresponding to the presence or absence of the light interruption, to the controller 400.

The sheet discharge sensor S3 detects a discharge of a sheet P, and outputs the detection result to the controller 400.

<Configuration of Image Forming Portion>

A configuration of the image forming portion 201B according to the first embodiment of the present invention will be described in detail with reference to FIGS. 1 to 3B.

The image forming portion 201B includes a laser scanner 210, process cartridges 211, a toner cartridge 215, a transfer belt 216, a driving roller 216*a*, and a tension roller 216*b*. The image forming portion 201B also includes a secondary transfer roller 217, primary transfer rollers 219, a fixing roller 220*a*, and a heating roller 220*b*. Further, the image forming portion 201B includes a pair of reversing rollers 222, a stacking portion 223, a pair of first discharge rollers 225*a*, a pair of second discharge rollers 225*b*, the registration roller 240, and a loop detection portion 300.

Here, the process cartridges 211 and the primary transfer rollers 219 constitute a primary transfer portion 201C. Here, the driving roller 216*a* and the secondary transfer roller 217 constitute a secondary transfer portion 201D arranged above the process cartridges 211. The fixing roller 220*a* and the heating roller 220*b* constitute the fixing portion 201E as a fixing unit arranged above the secondary transfer roller 217.

Between the secondary transfer portion 201D and the fixing portion 201E, a mechanism performing conveyance of a sheet P, such as rollers and a belt, is not provided. Therefore, the secondary transfer portion 201D and the fixing portion 201E are arranged in such a manner that a distance between the secondary transfer portion 201D and the fixing portion 201E is shorter than a length, in the conveyance direction, of a sheet P having the shortest length, in the conveyance direction, of usable sheets P.

The laser scanner 210 includes semiconductor lasers provided and corresponding to each of colors of yellow (Y), magenta (M), cyan (C), and black (B) any of which is not illustrated, and a corner surface body polygon mirror.

The semiconductor lasers are each switched on and emit laser light, based on image data transmitted from the image reading apparatus 202 and corresponding to each of the colors of yellow, magenta, cyan, and black. The corner surface body polygon mirror is driven by the exposure motor M1 performing rotation driving to perform deflection scanning with laser light emitted from each of the semiconductor lasers to form an electrostatic latent image on the photosensitive drum 212 of each of the process cartridges 211. Note that instead of the laser scanner 210, the image forming portion 201B may use an exposure apparatus that performs light-emitting diode (LED) switching control or the like.

The four process cartridges 211 are provided to form toner images of four colors of yellow, magenta, cyan, and black. Each of the process cartridges 211 includes the photosensitive drum 212, a charging device 213, and a development device 214.

The photosensitive drums 212 are image bearing members that rotate by the image formation motor M3 performing rotation driving. Surfaces of the photosensitive drums 212 are uniformly charged with a predetermined polarity and a predetermined electric potential by the charging devices 213. The uniformly charged surfaces of the photosensitive drums 212 are sequentially exposed to laser light emitted from the laser scanner 210 to form electrostatic latent images on the photosensitive drums 212, and the electrostatic latent images are developed by the development devices 214 to form toner images as developer images.

The charging devices 213 uniformly charge surfaces of the photosensitive drums 212 with a predetermined polarity and a predetermined electric potential.

The development devices 214 include developer conveying screws not illustrated. The developer conveying screws are driven by the image formation motor M3 performing rotation driving, to provide toners of four colors of yellow, magenta, cyan, and black for the photosensitive drums 212. The development devices 214 develop electrostatic latent images formed on surfaces of the photosensitive drums 212 with toners of four colors of yellow, magenta, cyan, and black, or a toner of a single color, to form toner images on the surfaces of the photosensitive drums 212.

The toner cartridge 215 provides toners of four colors of yellow, magenta, cyan, and black for each of the development devices 214 of each of the process cartridges 211, respectively.

The transfer belt 216 is wound around the driving roller 216*a* and the tension roller 216*b*.

Figure 2:
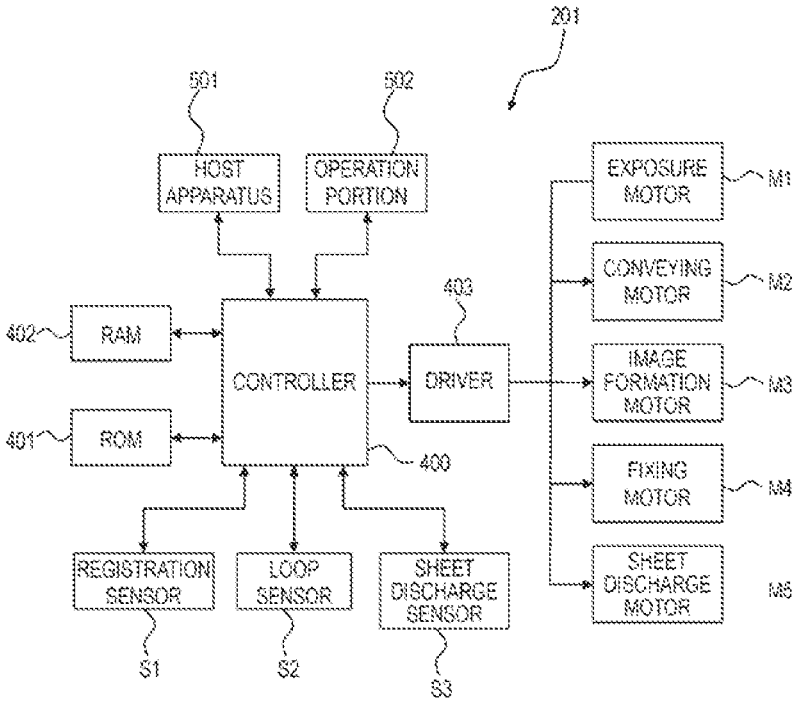
FIG. 2 is a block diagram that illustrates a configuration of the image forming apparatus according to the first embodiment of the present invention.

The driving roller 216*a* rotates by the image formation motor M3 performing rotation driving, and drives and rotates the transfer belt 216 in a direction of an arrow in FIG. 1.

The tension roller 216*b* drives and rotates the transfer belt 216 in a direction of the arrow in FIG. 1.

The secondary transfer roller 217 as a transfer unit is provided at a position opposite the driving roller 216*a*, and rotates by the image formation motor M3 performing rotation driving, to convey a sheet P conveyed from the registration roller 240 to the fixing portion 201E. The secondary transfer roller 217, together with the driving roller 216*a*, forms a transfer nip portion and nips the transfer belt 216 and a sheet P, and transfers a toner image transferred onto the transfer belt 216, to the sheet P.

The primary transfer rollers 219 are provided inside the transfer belt 216, and abut the transfer belt 216 at positions opposite the photosensitive drums 212. The primary transfer rollers 219 rotate by the image formation motor M3 performing rotation driving. The primary transfer rollers 219, together with the photosensitive drums 212, nip the transfer belt 216, and transfer toner images formed on the photosensitive drums 212, to the transfer belt 216.

The fixing roller 220*a* as a pressure-applying rotating member rotates by the fixing motor M4 performing rotation driving, and forms a fixing nip portion where a sheet P conveyed from the secondary transfer portion 201D is nipped and conveyed between the fixing roller 220*a* and the heating roller 220*b*.

The heating roller 220*b* as a heating rotating member heats toner images transferred to a sheet P by the secondary transfer portion 201D, at the fixing nip portion, to melt and fix the toner images on the sheet P.

The pair of reversing rollers 222 are rollers that can rotate regularly and oppositely. The pair of reversing rollers 222 rotates by the sheet discharge motor M5 performing rotation driving.

The stacking portion 223 protrudes in a bottom surface of the discharge space S, and sequentially stacks sheets P discharged by the pair of first discharge rollers 225*a* or the pair of second discharge rollers 225*b*.

The pair of first discharge rollers 225*a* rotates by the sheet discharge motor M5 performing rotation driving, to discharge a sheet P conveyed from the fixing portion 201E, into the stacking portion 223.

The pair of second discharge rollers 225*b* rotates by the sheet discharge motor M5 performing rotation driving, to discharge a sheet P conveyed from the fixing portion 201E, into the stacking portion 223.

The registration roller 240 as a conveying unit is driven and rotated by the conveying motor M2. The registration roller 240 forms a conveying nip portion, corrects skew feeding of sheets P conveyed, one sheet by one sheet, from the sheet feeding apparatus 230, and conveys the sheet P skew feeding of which has been corrected, to the secondary transfer portion 201D.

Figure 3A:
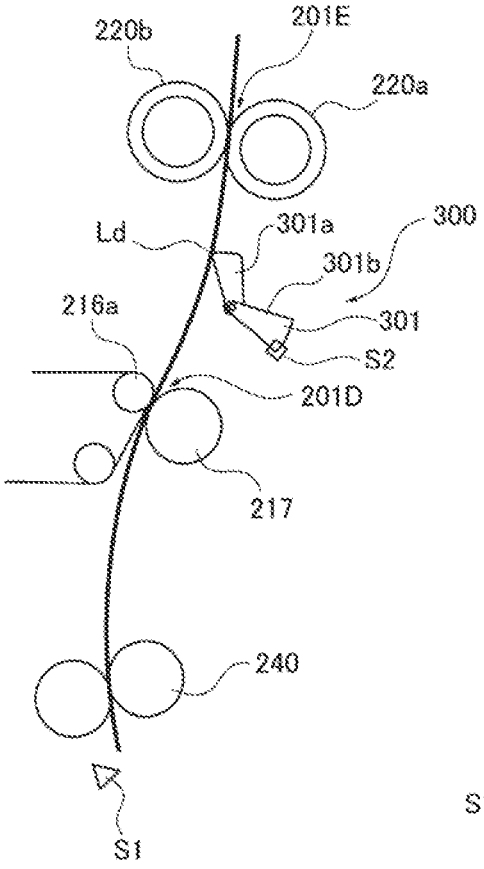
FIGS. 3A and 3B are schematic views that enlarge part of the image forming apparatus according to the first embodiment of the present invention.
Figure 3B:
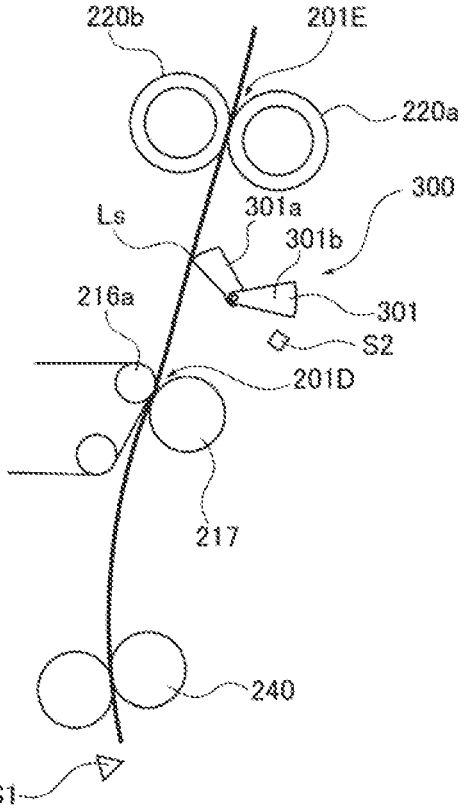

The loop detection portion 300 as a loop detection unit is provided in a conveyance path between the secondary transfer portion 201D and the fixing portion 201E, as illustrated in FIGS. 3A and 3B. The loop detection portion 300 detects a first loop state Ls illustrated in FIG. 3B that is a state where a loop of a sheet P is shallow, and a second loop state Ld illustrated in FIG. 3A that is a state where a loop of a sheet P is deep. More specifically, the loop detection portion 300 includes a loop sensor flag 301, a loop sensor flag spring not illustrated, and the loop sensor S2.

The loop sensor flag 301 can swing, and is energized by the loop sensor flag spring to maintain a state where the loop sensor flag 301 protrudes into the conveyance path. The loop sensor flag 301 includes a sheet abutting portion 301*a* and a sensor portion 301*b*. The sheet abutting portion 301*a* protrudes into the conveyance path to be in contact with a sheet P being conveyed between the secondary transfer portion 201D and the fixing portion 201E. The sheet abutting portion 301*a* swings according to a loop amount that the sheet P forms along the conveyance path. The sensor portion 301*b* swings integrally with the sheet abutting portion 301*a*, and interrupts or does not interrupt light to a sensing portion of the loop sensor S2.

The loop sensor S2 is provided between the secondary transfer portion 201D and the fixing portion 201E. Here, a photointerrupter is exemplified as the loop sensor S2. The loop sensor S2 outputs an ON signal to the controller 400 if light is interrupted by the sensor portion 301*b*, as illustrated in FIG. 3A, and outputs an OFF signal to the controller 400 if light is not interrupted by the sensor portion 301*b*, as illustrated in FIG. 3B.

Note that the loop detection portion 300 is not limited to a case where a loop is detected by the loop sensor S2 as a photointerrupter and the loop sensor flag 301, but may detect a loop by means of an optical sensor that directly detects a conveyance state of a sheet P.

<Operations of Image Forming Apparatus>

Operations of the image forming apparatus 201 according to the first embodiment of the present invention will be described in detail.

First, the image reading apparatus 202 reads image information of an original, and performs image processing of the read image information, and then converts the processed image information into an electrical signal, and transmits the electrical signal to the laser scanner 210 of the image forming portion 201B.

Next, the image forming portion 201B uniformly charges surfaces of the photosensitive drums 212 with a predetermined polarity and a predetermined electric potential by means of the charging devices 213.

Next, based on the electrical signal transmitted from the image reading apparatus 202, the image forming portion 201B irradiate the surfaces of the photosensitive drums 212 with laser light by means of the laser scanner 210 to sequentially expose the surfaces of the photosensitive drums 212. Consequently, electrostatic latent images that are of yellow, magenta, cyan, and black, and correspond to the image information read by the image reading apparatus 202 are sequentially formed on the photosensitive drum 212 of each of the process cartridges 211.

Next, the image forming portion 201B develops the electrostatic latent images on the photosensitive drums 212, with a toner of each of the colors, by means of the development devices 214, to form toner images and make the electrostatic latent images visible.

Next, the image forming portion 201B sequentially superimposes and transfers the toner images of each of the colors on each of the photosensitive drums 212, on and to the transfer belt 216, by means of first transfer biases applied to the primary transfer rollers 219. Consequently, toner images are formed on the transfer belt 216.

In parallel to the operations described above, sheets P are conveyed, one sheet by one sheet, to the registration roller 240, by the sheet feeding apparatus 230. Skew feeding of the sheets P is corrected by the registration roller 240. The registration sensor S1 detects the sheets P reaching a predetermined position.

The sheet P skew feeding of which has been corrected is conveyed to the secondary transfer portion 201D by the registration roller 240. At the secondary transfer portion 201D, the toner images formed on the transfer belt 216 are collectively transferred to the sheet P by means of a secondary transfer bias applied to the secondary transfer roller 217.

Next, the sheet P to which the toner images have been transferred is conveyed to the fixing portion 201E. Because the sheet P conveyed to the fixing portion 201E receives heat and pressure, the toners of each of the colors melt, the colors mix, and the toners are fixed on the sheet P, as a color image, or a black toner melts and is fixed on the sheet P, as a black and white image.

Because a conveyance velocity difference is provided for the secondary transfer portion 201D and the fixing portion 201E, flexure called a loop between the secondary transfer portion 201D and the fixing portion 201E is formed in a sheet P that is being conveyed between the secondary transfer portion 201D and the fixing portion 201E. Note that processing that forms such a loop will be described in detail in image forming processing described below.

Next, the sheet P on which the image has been fixed is discharged into the discharge space S by the pair of first discharge rollers 225*a* and the pair of second discharge rollers 225*b* provided downstream, in the conveyance direction, from the fixing portion 201E, and is stacked on the stacking portion 223 protruded in a bottom surface of the discharge space S.

Note that when images are formed on both sides of a sheet P, the sheet P on a front side of which an image has been fixed is conveyed to the reconveyance passage R by the pair of reversing rollers 222, and conveyed to the image forming portion 201B again, and an image is formed on the back side by means of operations similar to the operations described above, and the sheet P is discharged.

<Image Forming Processing>

Image forming processing according to the first embodiment of the present invention will be described in detail with reference to FIGS. 3A to 9.

Figure 4:
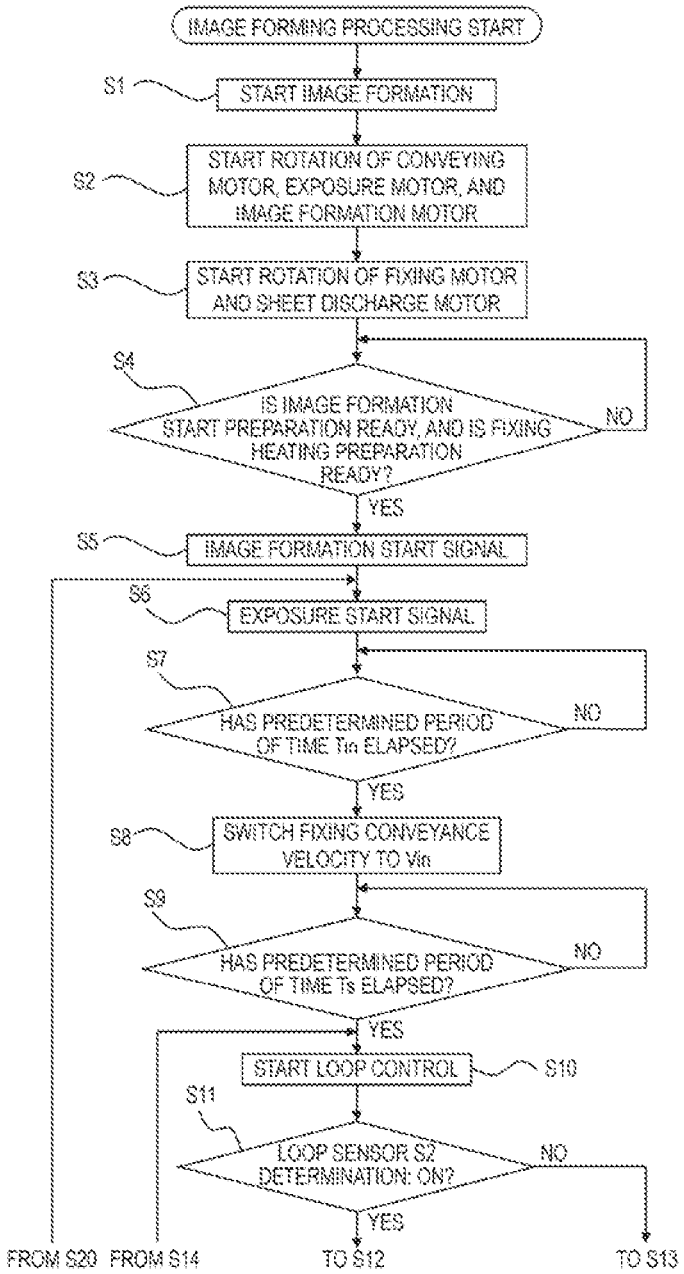
FIG. 4 is a flowchart that illustrates a former half of image forming processing according to the first embodiment of the present invention.
Figure 5:
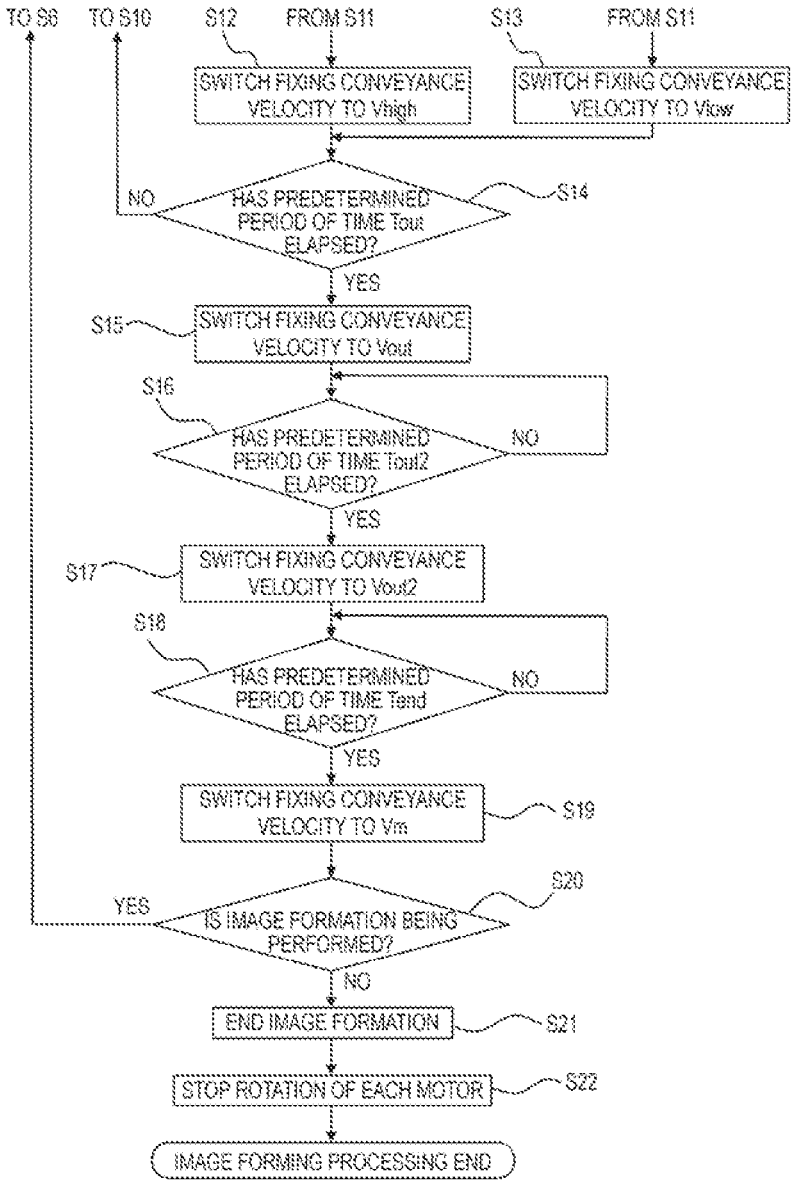
FIG. 5 is a flowchart that illustrates a latter half of the image forming processing according to the first embodiment of the present invention.

The image forming processing illustrated in FIGS. 4 and 5 is started at a timing when the controller 400 acquires printing data from the host apparatus 501, and information regarding image formation, such as a size of a sheet P, is input into the controller 400 from the operation portion 502.

First, the controller 400 converts the acquired printing data into image data, and outputs an image formation start instruction signal to the driver 403 to start image formation (S1).

Next, the controller 400 starts rotation of the exposure motor M1, the conveying motor M2, and the image formation motor M3 through the driver 403, at predetermined rotational speeds stored in the ROM 401 (S2).

Next, the controller 400 heats the heating roller 220*b* by means of a heater not illustrated of the fixing portion 201E. Then, when a surface of the heating roller 220*b* reaches a predetermined temperature among the control conditions stored in the ROM 401, the controller 400 issues an instruction on fixing heating preparation to the driver 403, and starts rotation of the fixing motor M4 through the driver 403 (S3). At this time, the controller 400 makes the fixing motor M4 rotate at a rotational speed Rm stored in the ROM 401 to make a fixing conveyance velocity become Vm.

Further, the controller 400 starts rotation of the sheet discharge motor M5 through the driver 403 synchronously with the start of rotation of the fixing motor M4 (S3). The controller 400 makes the sheet discharge motor M5 rotate at a rotational speed Rex stored in the ROM 401 so that a sheet discharge conveyance velocity Vex becomes slower than a velocity Vs of the transfer belt 216 (Vs>Vex).

Next, the controller 400 determines whether or not the fixing heating preparation of the fixing portion 201E is ready, and image formation start preparation of the exposure motor M1, the conveying motor M2, the image formation motor M3, the fixing motor M4, and the sheet discharge motor M5 is ready (S4).

If the fixing heating preparation is not ready, or the image formation start preparation is not ready (S4: No), the controller 400 repeats the processing of step S4.

On the other hand, if the fixing heating preparation is ready, and the image formation start preparation is ready (S4: Yes), the controller 400 outputs an image formation start signal to the driver 403 (S5). Then, the controller 400 makes the conveying motor M2 perform rotation driving through the driver 403 so that sheets P are fed from the sheet cassette 1, and conveyed, one sheet by one sheet, to the registration roller 240, or a sheet P is conveyed from the reconveyance passage R to the registration roller 240. After the sheet P is carried into the registration roller 240, the controller 400 temporarily stops the conveying motor M2 through the driver 403 to make the sheet P stand by at the registration roller 240.

Further, the controller 400 makes the image formation motor M3 perform rotation driving through the driver 403 to drive the transfer belt 216 at the constant velocity Vs. Further, the controller 400 makes the exposure motor M1 perform rotation driving through the driver 403 so that a writing velocity of an electrostatic latent image on the photosensitive drum 212 in each of the process cartridges 211 after a start of exposure substantially corresponds to the velocity Vs of the transfer belt 216. Note that the writing velocity of an electrostatic latent image on the photosensitive drum 212 is calculated by the controller 400, based on a result of reading a velocity stabilization control patch, not illustrated, on the transfer belt 216 before image formation, and is set according to conditions recorded in the ROM 401.

Next, the controller 400 outputs an exposure start signal to the driver 403 (S6). Consequently, the exposure motor M1 performs rotation driving by control by the driver 403 to start to form an electrostatic latent image on the photosensitive drum 212 of each of the process cartridges 211. Then, after toner images formed on the photosensitive drums 212 start to be transferred to the transfer belt 216, the controller 400 outputs a sheet refeeding start instruction signal to the driver 403 so that the registration roller 240 is driven and rotated through the driver 403 to start to convey the sheet P.

At this time, the controller 400 output the sheet refeeding start instruction signal at a timing that allows the toner images formed on the transfer belt 216 to be transferred to the sheet P detected by the registration sensor S1, at the secondary transfer portion 201D. Consequently, the sheet P conveyed from the registration roller 240 reaches the secondary transfer portion 201D, and is conveyed to the fixing portion 201E while secondary transfer is performed to the sheet P.

Next, the controller 400 determines whether or not a predetermined period of time Tin has elapsed from a time of the output of the exposure start signal (S7). Here, a time of a lapse of the predetermined period of time Tin from the time of the output of the exposure start signal is a point after a front end, in the conveyance direction, of the sheet P (hereinafter, simply described as the "front end of the sheet P") passing through the secondary transfer portion 201D, and before the front end of the sheet P reaching the fixing nip portion of the fixing portion 201E.

If the predetermined period of time Tin has not elapsed (S7: No), the controller 400 repeats the processing of step S7.

On the other hand, if the predetermined period of time Tin has elapsed (S7: Yes), the controller 400 changes a rotational speed of the fixing motor M4 into a rotational speed Rin stored in the ROM 401 to switch the fixing conveyance velocity from the velocity Vm to a velocity Vin (S8).

Figure 6:
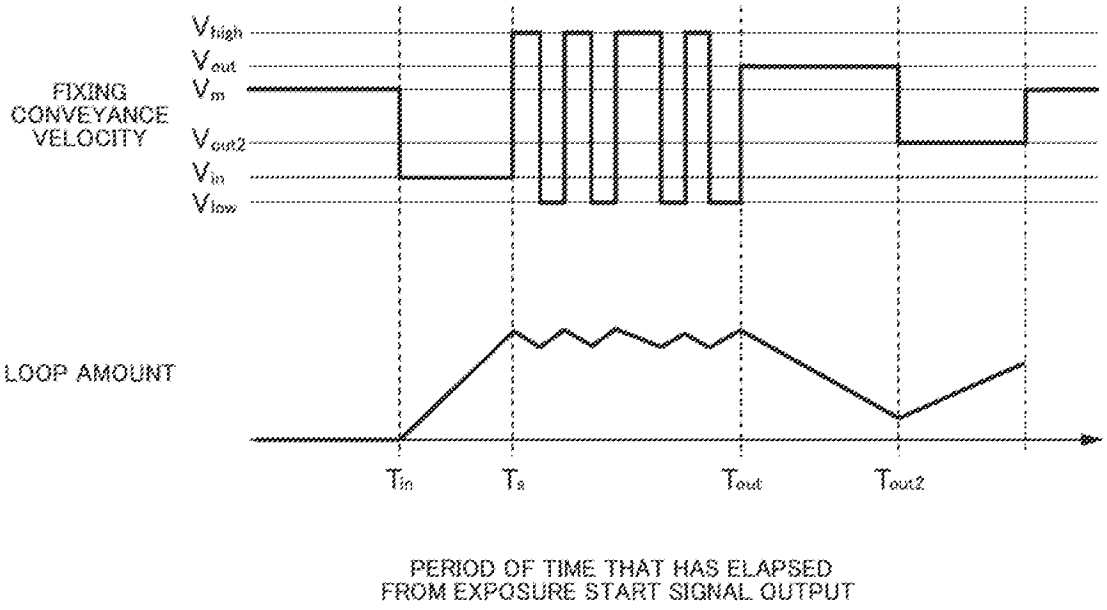
FIG. 6 is a drawing that illustrates a transition of a loop amount of a sheet in the image forming apparatus according to the first embodiment of the present invention.

Here, the velocity Vin is set to a velocity slower than the velocity Vm, as illustrated in FIG. 6, and slower than the velocity Vs of the transfer belt 216 so that a loop is formed in the sheet P between the secondary transfer portion 201D and the fixing portion 201E. Due to the forming a loop in the sheet P, the sheet P is not pulled by the fixing portion 201E, and a secondary transfer image is not distorted.

Further, if a color image is formed, the predetermined period of time Tin is calculated as follows:

(1) It is supposed that a distance from an exposure position on the photosensitive drum 212 of the process cartridge 211 performing yellow image formation (at the left end in FIG. 1), to a transfer nip position (primary transfer position) between the photosensitive drum 212 and the primary transfer roller 219 is A.

(2) It is supposed that a distance from the transfer nip position of (1) described above to a transfer nip position that is on the photosensitive drum 212 of the process cartridge 211 performing black image formation (at the right end in FIG. 1), and is between the photosensitive drum 212 and the primary transfer roller 219 is B.

(3) It is supposed that a distance from the transfer nip position that is on the photosensitive drum 212 of the process cartridge 211 performing black image formation, and is between the photosensitive drum 212 and the primary transfer roller 219, to a transfer position of the secondary transfer portion 201D is C.

(4) It is supposed that a distance from the transfer position of the secondary transfer portion 201D to an optional position before the fixing nip portion of the fixing portion 201E is D.

(5) The predetermined period of time Tin is calculated by dividing the four distances A, B, C, and D added together, by the velocity Vs of the transfer belt 216 that has been set (Tin=(A+B+C+D)/Vs).

The distances A, B, and C described above are distances depending on a configuration of the image forming apparatus 201, and is preliminarily stored in the ROM 401. The distance D and the velocity Vs of the transfer belt 216 are stored in the RAM 402 in such a manner that the distance D and the velocity Vs of the transfer belt 216 can be changed as necessary. Therefore, the controller 400 can calculate the predetermined period of time Tin by using the distances A, B, and C stored in the ROM 401, and the distance D and the velocity Vs of the transfer belt 216 stored in the RAM 402.

Next, the controller 400 determines whether or not a predetermined period of time Ts has elapsed from the time of the output of the exposure start signal (S9). Here, a time of a lapse of the predetermined period of time Ts from the time of the output of the exposure start signal is a point after the front end of the sheet P passing through the fixing portion 201E, and before a rear end, in the conveyance direction, of the sheet P (hereinafter, simply described as the "rear end of the sheet P") passing through the registration roller 240.

In a case of before a lapse of the predetermined period of time Ts (S9: No), the controller 400 repeats the processing of step S9.

On the other hand, if the predetermined period of time Ts has elapsed (S9: Yes), the controller 400 starts loop control that selectively switches the fixing conveyance velocity to make a loop amount of the sheet P between the secondary transfer portion 201D and the fixing portion 201E become substantially constant (S10). In the loop control, the controller 400 controls the loop amount in such a manner that the loop amount is within a predetermined range by selectively switching the fixing conveyance velocity, based on a detection result with the loop sensor S2 that follows and is obtained by an operation of the loop sensor flag 301 abutting the sheet P.

Note that a timing of the loop control start may be set to a time before the front end of the sheet P reaching the fixing portion 201E.

Next, based on an ON signal or OFF signal input from the loop sensor S2, the controller 400 determines whether or not determination is ON determination (S11).

In a case of ON determination due to input of an ON signal from the loop sensor S2 (S11: Yes), the controller 400 determines that the sheet P is in the second loop state Ld illustrated in FIG. 3A. Then, to eliminate the loop, the controller 400 makes the fixing motor M4 rotate at a rotational speed Rhigh stored in the ROM 401 so that the fixing conveyance velocity is switched to a velocity Vhigh (second velocity) faster than the velocity Vs of the transfer belt 216 (Vs<Vhigh) (S12).

On the other hand, in a case of OFF determination due to input of an OFF signal from the loop sensor S2 (S11: No), the controller 400 determines that the sheet P is in the first loop state Ls illustrated in FIG. 3B where the loop sensor flag 301 returns to a standing-by position, due to a decrease in a loop of the sheet P, or the like. Then, to form a loop, the controller 400 makes the fixing motor M4 rotate at a rotational speed Rlow stored in the ROM 401 so that the fixing conveyance velocity is switched to a velocity Vlow (first velocity) slower than the velocity Vs of the transfer belt 216 (Vs>Vlow) (S13).

Next, the controller 400 determines whether or not a predetermined period of time Tout has elapsed from the time of the output of the exposure start signal (S14). Here, a time of a lapse of the predetermined period of time Tout from the time of the output of the exposure start signal is a point before the rear end of the sheet P passing through the registration roller 240.

In a case of before a lapse of the predetermined period of time Tout (S14: No), the controller 400 returns to the processing of step S10.

On the other hand, if the predetermined period of time Tout has elapsed (S14: Yes), the controller 400 changes a rotational speed of the fixing motor M4 into a rotational speed Rout stored in the ROM 401. Consequently, the controller 400 switches the fixing conveyance velocity from the velocity Vhigh or velocity Vlow to a velocity Vout as a third velocity (S15).

The velocity Vout is a velocity slower than the velocity Vhigh and a velocity slightly faster than the velocity Vs of the transfer belt 216 (Vs<Vout<Vhigh), and is a velocity that can decrease a loop amount of a sheet P between the secondary transfer portion 201D and the fixing portion 201E. The reason why the velocity Vout is made faster than the velocity Vs of the transfer belt 216 is that when a rear end of a sheet P passes through the registration roller 240, a loop amount of the sheet P between the secondary transfer portion 201D and the fixing portion 201E is made smaller than a predetermined amount. Consequently, a bending reaction force of the sheet P is decreased, and a secondary transfer image is not distorted.

Here, a method of determining a length of a section that decreases a loop amount of a sheet P between the secondary transfer portion 201D and the fixing portion 201E (hereinafter, described as the "loop decreasing section") will be described.

In the loop decreasing section, it is difficult to detect a loop amount with a simple configuration. Therefore, loop control is not performed, and the fixing roller 220*a* is driven at a constant rotational speed preliminarily stored in the ROM 401. However, because the fixing roller 220*a* has a radius that varies in the circumference direction, a conveyance velocity varies while the fixing roller 220*a* rotates one time. Consequently, a loop amount of a sheet P regularly varies.

Figure 7:
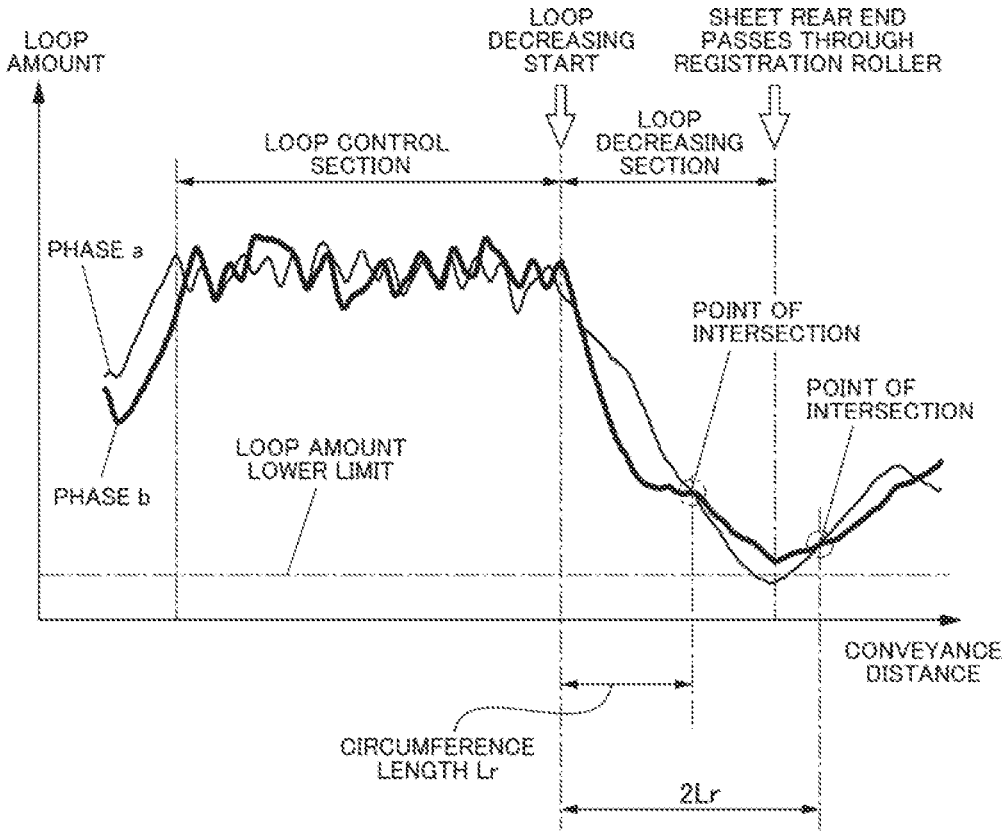
FIG. 7 is a drawing that illustrates a transition of a loop amount of a sheet in a section that controls a loop amount of a sheet in the image forming apparatus according to the first embodiment of the present invention.

In FIG. 7, a phase a and a phase b are rotational phases of the fixing roller 220*a* that become the fixing nip portion at a time of a start of a loop decreasing section. The phase a is a rotational phase that generates lines in an image at a timing when a rear end of a sheet P passes through the registration roller 240. The phase b is a rotational phase that does not generate lines in an image at a timing when a rear end of a sheet P passes through the registration roller 240.

As illustrated in FIG. 7, since in a loop control section where loop control is performed, a loop amount is controlled to restrict variations due to the conveyance, the loop amount is a substantially constant value, irrespective of a rotational phase of the fixing roller 220*a* that becomes the fixing nip portion at a time of a start of the loop control section. On the other hand, in a loop decreasing section, the conveyance velocity varies according to a rotational phase of the fixing roller 220*a* that becomes the fixing nip portion at a time of a start of the loop decreasing section. Therefore, a loop amount also varies. In a case of FIG. 7, a loop amount of a sheet P of the phase b is larger than a loop amount of a sheet P of the phase a, at a timing when rear ends of the sheets P pass through the registration roller 240. The difference in the loop amounts causes the presence or absence of generation of the image defect.

On the other hand, as illustrated in FIG. 7, a loop amount of the phase a and a loop amount of the phase b correspond at a distance Lr where the fixing roller 220*a* rotates one time from the time of the start of the loop decreasing section, and at a distance 2Lr where the fixing roller 220*a* rotates two times from the time of the start of the loop decreasing section. The reason is that a circumference length of the fixing roller 220*a* is constant, irrespective of rotational phases. Therefore, a distance that is the circumference length of the fixing roller 220*a* multiplied by an integer, and where a loop amount of the phase a and a loop amount of the phase b correspond is made to be a loop decreasing section. Consequently, variations in a loop amount due to rotational phases of the fixing roller 220*a* do not occur.

Consequently, in the present embodiment, the fixing conveyance velocity is controlled so that a length of a loop decreasing section becomes the circumference length of the fixing roller 220*a* multiplied by an integer. Consequently, a loop amount at a timing when a rear end of a sheet P passes through the registration roller 240 and an image defect is generated is stabilized, and generation of the image defect is restricted.

In this way, a length of a loop decreasing section is determined from a velocity and a timing at which a sheet P is conveyed. Further, the predetermined period of time Tout is determined as follows:

(1) It is supposed that a length, in the conveyance direction, of a sheet P preliminarily input into the operation portion 502 by a user, or sensed by a sheet regulation plate position or the like, not illustrated, of the sheet cassette 1 when the sheet P is loaded into the sheet cassette 1 is L.

(2) It is supposed that a distance from the secondary transfer portion 201D to the registration roller 240 is E.

(3) It is supposed that among the pair of rollers that constitutes the fixing portion 201E, the fixing roller 220*a* that receives and is driven by a driving force from the fixing motor M4 has a circumference length Lr.

(4) The distances A, B, and C described above, and the length L, in the conveyance direction, of the sheet P are added together to become a value. From the value, the distance E, and a length that is the circumference length Lr multiplied by an integer N (N is an integer equal to or larger than one) are subtracted to determine a value. Then, the determined value is divided by the velocity Vs of the transfer belt 216 that has been set, to calculate a predetermined period of time Tout ($Tout=(A+B+C+L-E-(N\times Lr))/Vs$).

Figure 8:
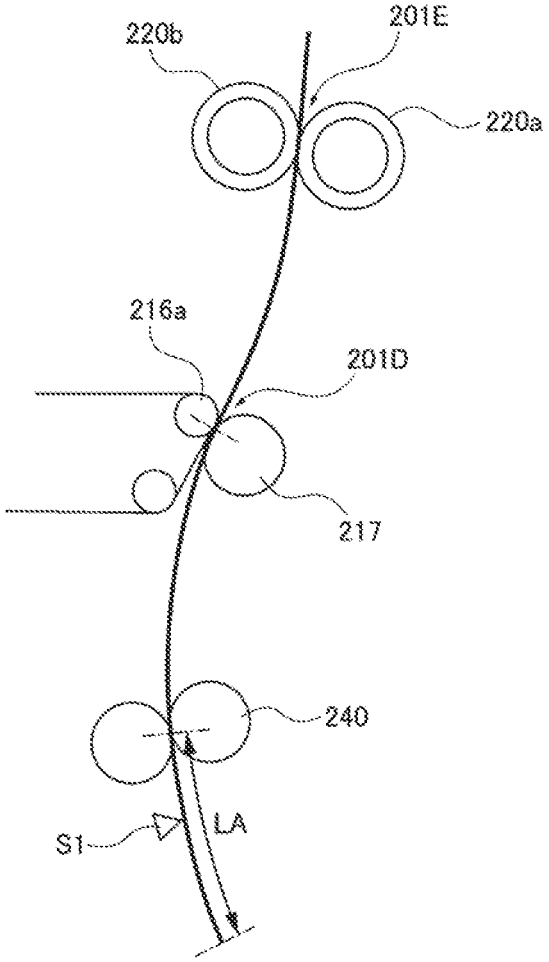
FIG. 8 is a schematic view that illustrates a state of a sheet at a time of a start of loop-amount decreasing processing in the image forming apparatus according to the first embodiment of the present invention.

Consequently, a rear end of a sheet P at a time of a lapse of the predetermined period of time Tout from a time of output of an exposure start signal is at a position (first position) that is upstream from the conveying nip portion of the registration roller 240, by a length LA that is the circumference length Lr of the fixing roller 220*a* multiplied by an integer N ($LA=N\times Lr$), as illustrated in FIG. 8. By setting in this way, a distance conveyed at the velocity Vout that decreases a loop amount is made to be the circumference length Lr of the fixing roller 220*a* multiplied by an integer.

Note that in the image forming processing illustrated in FIGS. 4 and 5, a unit that maintains a loop amount at a constant value by loop control is not limited to the loop detection portion 300, but may be a prediction based on a conveyance distance, or the like.

Figure 9:
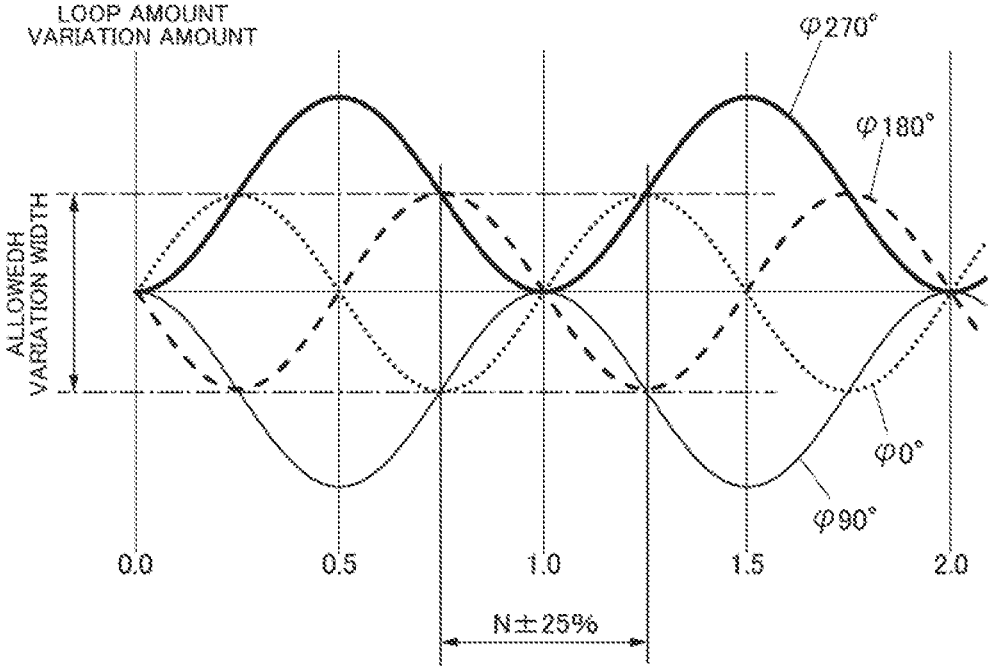
FIG. 9 is a drawing that illustrates a variation in a loop amount at a time of changing a length of a section that decreases a loop amount in the image forming apparatus according to the first embodiment of the present invention.

FIG. 9 illustrates variations in loop amounts of sheets P at a time of changing a length of a loop decreasing section. In FIG. 9, 1.0 on the horizontal axis indicating a conveyance distance indicates a position where conveyance is performed by a distance that is the circumference length Lr of the fixing roller 220*a* multiplied by an integer from 0.0 that is a position at a time of a lapse of a predetermined period of time Tout from a time of output of an exposure start signal (a time of a start of a loop decreasing section).

A rotational phase ψ of the fixing roller 220*a* that becomes the fixing nip portion at a time of a lapse of a predetermined period of time Tout from a time of output of an exposure start signal changes for every sheet P. Therefore, a variation width of a loop amount corresponding to a conveyance distance also varies for every sheet P.

On the other hand, if a distance across which a sheet P is conveyed at the velocity Vout is the circumference length Lr of the fixing roller 220*a* multiplied by an integer, a loop winding amount from a time of a start of a loop decreasing section to a rear end of the sheet P passing through the registration roller 240 is the same, irrespective of the rotational phase ψ, as illustrated in FIG. 9. Here, the loop winding amount is an amount that decreases a loop amount. Therefore, to restrict conveyance variations due to rotational phases, a distance across which a sheet P is conveyed at the velocity Vout can be set to the circumference length Lr of the fixing roller 220*a* multiplied by an integer.

In the present embodiment, however, it is supposed that a realistic effect range of an allowed variation width of a loop amount that restricts generation of an image defect is a range that is the circumference length Lr of the fixing roller 220*a* multiplied by an integer N±25% (N±25%), as illustrated in FIG. 9. Note that although it is supposed that the realistic effect range is ±25%, the realistic effect range is not limited to the range of the present embodiment if a distance across which a sheet P is conveyed at the velocity Vout is made closer to the circumference length Lr of the fixing roller 220*a* multiplied by an integer.

With reference to FIG. 5 again, next, the controller 400 determines whether or not a predetermined period of time Tout2 has elapsed from the time of the output of the exposure start signal (S16). Here, a time of a lapse of the predetermined period of time Tout2 from the time of the output of the exposure start signal is a point after the rear end of the sheet P passing through the registration roller 240, and before the rear end of the sheet P passing through the secondary transfer portion 201D.

In a case of before a lapse of the predetermined period of time Tout2 (S16: No), the controller 400 repeats the processing of step S16.

On the other hand, if the predetermined period of time Tout2 has elapsed (S16: Yes), the controller 400 changes a rotational speed of the fixing motor M4 into a rotational speed Rout2 stored in the ROM 401. Consequently, the controller 400 switches the fixing conveyance velocity from the velocity Vout to a velocity Vout2 (S17).

The velocity Vout2 is a velocity slightly slower than the velocity Vs of the transfer belt 216 (Vout2<Vs), and is a velocity that can increase again a loop amount of a sheet P between the secondary transfer portion 201D and the fixing portion 201E. Consequently, after the rear end of the sheet P passes through the registration roller 240, a loop amount of the sheet P is increased. Therefore, the sheet P is not excessively pulled by the fixing portion 201E, and the secondary transfer image is not distorted.

Here, in a case of image formation of a color image, the predetermined period of time Tout2 is calculated as follows: It is supposed that a distance from the secondary transfer portion 201D to the registration roller 240 is E. Then, the distances A, B, and C described above, and a length L, in the conveyance direction, of a sheet P are added together to become a value. The value from which the distance E is subtracted is divided by the velocity Vs of the transfer belt 216 that has been set, to determine a predetermined period of time Tout2 ($Tout2=(A+B+C+L-E)/Vs$). The distance E is stored in the RAM 402 in such a manner that the distance E can be changed as necessary.

Next, the controller 400 determines whether or not a predetermined period of time Tend has elapsed from the time of the output of the exposure start signal (S18). Here, a time of a lapse of the predetermined period of time Tend from the time of the output of the exposure start signal is a point after the rear end of the sheet P passing through the secondary transfer portion 201D, and before the rear end of the sheet P passing through the fixing nip portion of the fixing portion 201E.

In a case of before a lapse of the predetermined period of time Tend (S18: No), the controller 400 repeats the processing of step S18.

On the other hand, if the predetermined period of time Tend has elapsed (S18: Yes), the controller 400 switches the fixing conveyance velocity to the velocity Vm (S19).

Next, the controller 400 determines whether or not image formation is being performed (S20).

If image formation is being performed (S20: Yes), the controller 400 returns to the processing of step S6.

On the other hand, if image formation is not being performed (S20: No), the controller 400 determines that a sheet P on which an image has been formed at the end is a final image formation sheet, and ends image formation (S21). The final image formation sheet P is discharged into the discharge space S by the pair of first discharge rollers 225*a* or the pair of second discharge rollers 225*b*. At this time, the fixing conveyance velocity is not switched and remains at the above fixing conveyance velocity Vm, and rotation is performed until the sheet discharge sensor S3 senses the discharge of the sheet.

Next the controller 400 stops rotation of the exposure motor M1, the conveying motor M2, the image formation motor M3, the fixing motor M4, and the sheet discharge motor M5 through the driver 403 (S22), and ends the image forming processing.

In the present embodiment, when a rear end of a sheet P reaches a position that is upstream, in the conveyance direction, from the registration roller 240, by a distance that is a circumference length of the fixing roller 220*a* multiplied by an integer, a conveyance velocity of the fixing portion 201E is maintained at a constant velocity. Further, a loop amount of the sheet P is decreased compared with before a rear end of the sheet P reaches a position that is upstream, in the conveyance direction, from the registration roller 240, by a distance that is a circumference length of the fixing roller 220*a* multiplied by an integer. Consequently, even if a diameter of the fixing roller 220*a* of the fixing portion 201E varies according to rotational phases, a loop amount of a sheet P is stabilized, and generation of an image defect is restricted.

Second Embodiment

A configuration of an image forming apparatus according to a second embodiment of the present invention is the same as the configuration in FIGS. 1 to 3B. Therefore, descriptions of the configuration of an image forming apparatus according to the second embodiment will be omitted.

<Image Forming Processing>

Image forming processing according to the second embodiment of the present invention will be described in detail with reference to FIG. 10.

An only difference between the image forming processing according to the present embodiment and the image forming processing illustrated in FIGS. 4 and 5 is a setting of a section that increases a loop amount of a sheet P after a predetermined period of time Tout2 elapses from a time of output of an exposure start signal (hereinafter, described as the "loop increasing section"). Therefore, descriptions except the loop increasing section are omitted in the present embodiment.

If a loop amount between the fixing portion 201E and the secondary transfer portion 201D is too small when a rear end of a sheet P passes through the secondary transfer portion 201D, the sheet P is not along the transfer belt 216 at the rear end of the sheet P, and an image defect is generated. On the other hand, if a loop amount between the fixing portion 201E and the secondary transfer portion 201D is too large, an image defect, such as color misalignment, is generated. Therefore, a conveyance distance needs to be stabilized also for the loop increasing section.

Here, in the loop increasing section, it is difficult to sense a loop amount with a simple configuration, similarly as the loop decreasing section. Therefore, loop control is not performed, and the fixing roller 220*a* is driven and rotated at a rotational speed preliminarily stored in the ROM 401.

Consequently, similarly as the loop decreasing section, a length of the loop increasing section is set to a circumference length of the fixing roller 220*a* multiplied by an integer. The length of the loop increasing section is determined from a velocity and a timing at which a sheet P is conveyed. Further, a predetermined period of time Tout2 at this time is determined as follows:

(1) It is supposed that the fixing roller 220*a* that receives and is driven by a driving force from the fixing motor M4 has a circumference length Lr.

(2) The distances A, B, and C described above, and a length L, in the conveyance direction, of a sheet P are added together to become a value. From the value, a length that is the circumference length Lr of the fixing roller 220*a* multiplied by an integer N is subtracted to determine a value. Then, the determined value is divided by the velocity Vs of the transfer belt 216 that has been set (Tout2=(A+B+C+L−(N×Lr))/Vs).

Figure 10:
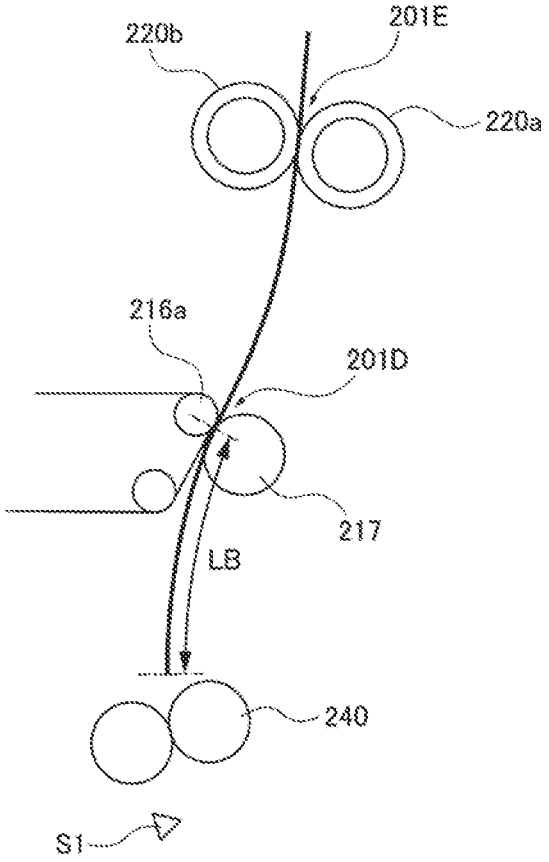
FIG. 10 is a schematic view that enlarges part of an image forming apparatus according to a second embodiment of the present invention.

Consequently, a rear end of a sheet P at a time of a lapse of the predetermined period of time Tout2 from a time of output of an exposure start signal is at a position (second position) that is upstream, in the conveyance direction, from the transfer nip portion of the secondary transfer portion 201D, by a length LB that is the circumference length Lr of the fixing roller 220*a* multiplied by an integer N (LB=N×Lr), as illustrated in FIG. 10. By setting in this way, a distance conveyed at the velocity Vout2 that increases a loop amount is made to be the circumference length Lr of the fixing roller 220*a* multiplied by an integer. Therefore, generation of an image defect is restricted.

In the present embodiment, however, it is supposed that a realistic effect range of an allowed variation width of a loop amount that restricts generation of an image defect is a range that is the circumference length Lr of the fixing roller 220*a* multiplied by an integer ±25%, similarly as the first embodiment described above. Note that although it is supposed that the realistic effect range is ±25%, the realistic effect range is not limited to the range of the present embodiment if a distance across which a sheet P is conveyed at the velocity Vout2 is made closer to the circumference length Lr of the fixing roller 220*a* multiplied by an integer.

Needless to say, the present invention is not limited to the embodiments described above, but may be variously modified without departing from the gist of the present invention.

More specifically, in the first and second embodiments described above, the conveying motor M2 drives and rotates the fixing roller 220*a*. A motor driven and rotated by the conveying motor M2 is not limited to this, but the conveying motor M2 may drive and rotate the heating roller 220*b*. In this case, distances conveyed at the velocity Vout that decreases a loop amount and at the velocity Vout2 that increases a loop amount are made to be a circumference length Lr of the heating roller 220*b* multiplied by an integer.

Further, in the first and second embodiments described above, a conveying roller is not provided between the registration roller 240 and the secondary transfer portion 201D. The configuration is not limited to this, but a conveying roller as a conveying unit may be provided between the registration roller 240 and the secondary transfer portion 201D. In this case, a loop amount of a sheet P is decreased when a rear end of the sheet P reaches a position that is upstream, in the conveyance direction, from the conveying roller between the registration roller 240 and the secondary transfer portion 201D, by a distance that is a circumference length of the fixing roller 220*a* multiplied by an integer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-162086, filed Sep. 28, 2020, which is hereby incorporated by reference herein in its entirety.

What is claimed is:

1. An image forming apparatus comprising:

a transfer unit that forms a transfer nip portion, and conveys a recording medium while transferring a toner image formed on an image bearing member;

a conveying unit that is provided upstream of the transfer unit in a conveyance direction of the recording medium, forms a conveying nip portion, and conveys the recording medium to the transfer unit;

a fixing unit that are included a heating rotating member and a pressure-applying rotating member that forms a fixing nip portion together with the heating rotating member, and conveys the recording medium while heating the toner image transferred to the recording medium by the transfer unit, at the fixing nip portion, to melt and fix the toner image on the recording medium; and a control unit that controls a conveyance velocity of conveying the recording medium by the fixing unit, to form a loop in the recording medium between the transfer nip portion and the fixing nip portion, wherein the control unit controls the conveyance velocity to decrease the loop when a rear end of the recording medium reaches a first position that is apart upstream, in the conveyance direction, from the conveying nip portion of the conveying unit, by a distance that corresponds to a circumference length of the pressure-applying rotating member multiplied by an integer.

2. The image forming apparatus according to claim 1, further comprising a loop detection unit that is provided between the transfer nip portion and the fixing nip portion, and detects an amount of the loop, wherein before the rear end of the recording medium reaches the first position, the control unit controls the conveyance velocity in such a manner that the amount of the loop is within a predetermined range, on a basis of a detection result of the amount of the loop detected by the loop detection unit.

3. The image forming apparatus according to claim 2, wherein the conveyance velocity at a time of loop control by the loop detection unit is controlled at a first velocity (Vlow) and a second velocity (Vhigh) faster than the first velocity, and after a rear end of the recording medium passes through the first position, the conveyance velocity decreases the loop at a third velocity (Vout) slower than the second velocity.

4. The image forming apparatus according to claim 1, wherein the control unit controls the conveyance velocity to increase the loop when the rear end reaches a second position that is apart upstream, in the conveyance direction, from the transfer nip portion of the transfer unit, by a distance that is the circumference length of the pressure-applying rotating member multiplied by an integer.

5. The image forming apparatus according to claim 4, further comprising a sensing unit that is provided upstream, in the conveyance direction, from the conveying unit, and senses the recording medium, wherein the second position is a position of a rear end of a sheet being conveyed, at a time of a lapse of a predetermined period of time after the rear end of the sheet is sensed by the sensing unit.

6. The image forming apparatus according to claim 1, wherein the first position allows a dispersion of 25% to the circumference length of the pressure-applying rotating member multiplied by the integer.

* * * * *